United States Patent [19]

Tisdale et al.

[11] Patent Number: 4,596,493

[45] Date of Patent: Jun. 24, 1986

[54] APPARATUS AND METHOD FOR THE PERFORMANCE OF WORK ON SUBMERGED ARTICLES

[75] Inventors: Benjamin Tisdale, Anchorage, Ak.; John Chanslor, Lafayette, La.; William B. Nicholson, Corpus Christi, Tex.

[73] Assignee: Martech International, Inc., Houston, Tex.

[21] Appl. No.: 549,154

[22] Filed: Nov. 7, 1983

[51] Int. Cl.[4] ..... B63C 11/00; E02F 5/10

[52] U.S. Cl. ..... 405/185; 37/63; 405/74; 405/158

[58] Field of Search ..... 405/73, 74, 185, 190, 405/191, 158, 169; 37/58, 62, 63, 78

[56] References Cited

U.S. PATENT DOCUMENTS

| | | | |
|---|---|---|---|
| 3,393,524 | 7/1968 | Terrell | 405/185 |
| 3,508,410 | 4/1970 | Lynch | 405/190 |
| 3,706,142 | 12/1972 | Brunner | 405/191 X |
| 4,189,253 | 2/1980 | Pekor | 405/74 |

*Primary Examiner*—David H. Corbin

*Attorney, Agent, or Firm*—Bernard A. Reiter

[57] ABSTRACT

An apparatus and method for working on a submerged object comprising a work platform having jetting means carried thereby for excavating the floor beneath the body of water and around the object.

10 Claims, 4 Drawing Figures

APPARATUS AND METHOD FOR THE PERFORMANCE OF WORK ON SUBMERGED ARTICLES

BACKGROUND OF THE INVENTION

The performance of work in pursuit of repair or retrieval of submerged articles encounters numerous obstacles. The article, for example, is submerged in an environment where normal physical movements encounter substantial resistance from the water itself. The depth of the water influences the magnitude of the obstacles though shallow water is frequently more difficult to work in than deeper water due to the presence of surf and current. Also, the article on which the work takes place is frequently partially buried in silt or mud and work thereon encounters additional difficulty due to reduced visibility. Substantial technological efforts have been made toward the accomplishment of the performance of work on objects in relatively deep water through the use of improved diving gear and a wide variety of underwater vehicles. These types of technological improvements however are of little value in the performance of work in shallow waters, particularly waters proximate the shoreline where extreme waves, surf and poor underwater visibility characterize the numerous obstacles encountered in the retrieval of or performance of work on submerged articles. In these areas between the land itself where normal work methods may be performed and the deeper water where more sophisticated technology can be utilized the aformentioned obstacles and numerous other problems have hindered the accomplishment of effective work procedures on such articles as submerged and partially buried pipelines, small vessels, and lost equipment.

The apparatus of the present invention and the method described hereafter with respect thereto has found useful application in the retrieval of objects and the performance of repair procedures on objects in the mid-surf area and in relatively shallow depths, and although it is foreseen that the apparatus described herein can be varied in size to accomplish the work on objects which are the subject hereof, it is contemplated that optimal usage occurs in water depths of up to 20 feet. The apparatus and method is particularly applicable for use in the near surf where the turbulence of wave action and current make the performance of underwater work, both difficult and dangerous, for divers and other repair personnel.

BRIEF SUMMARY OF THE INVENTION

The present invention relates to a portable platform adapted to be transported, substantially in toto, from a shoreline location, such as by helicopter, to an offshore location, commonly in the area of the near surf. It is in generally shallow waters, including the operating characteristics of the surf, that the present invention finds prominent application. The apparatus and method hereof has, for example, been found to be markedly advantageous in the repair of submerged pipelines, in relatively shallow but rough water where water visibility is low, and wave action are particularly threatening. Thus, the present invention has as a principal object thereof the provision for a deployable structure to be set adjacent to or over a shallow, submerged object and which nevertheless enables the passage of wave action through the structure and without posing resistance thereto.

It is a further object of the invention to provide a deployable structure, in toto, above an object in relatively shallow water so as to provide a stable operating platform from which an operating crew may perform its work.

It is yet another further object of the invention to provide a deployable platform, in toto, at an offshore location above or adjacent to an article on which work is to be performed and which supports equipment used in connection with such work.

Still another object and advantage of the invention resides in a platform, deployable substantially in toto, at an offshore location and which carries suction eductor pipes thereon for dredging soil and/or mud from adjacent the object on which work is to be performed.

Still another further object and advantage of the invention resides in an apparatus and method associated therewith consisting of a work platform, deployable in toto, to an offshore location, and from which repair work on an object and from which repair work on the object is carried out by educting sand and/or soil from around the object so as to faciliate work thereon even though it is partially submerged in the sand or soil.

Still another feature and advantage of the invention resides in an apparatus and method for facilitating work on or retrieval of an object partially buried in the sand and/or soil beneath the surface of a body of water.

Yet another feature and advantage of the invention resides in a portable platform, deployable in toto, to an offshore location in a body of water, and from which limited dredging operations may take place for revealing a partially submerged body, such as a pipeline, so that repair work may take place thereon.

Yet another feature and advantage of the invention resides in a method for repairing an article submerged in a body of water by selectively evacuating sand and/or soil or the like from around the partially buried object so as to enable repair work thereon.

Another feature and advantage of the invention provides in an apparatus and method for repairing a submerged pipeline partially buried in the floor of a body of water by deploying a platform thereover from which work may be done and by excavating around the pipe so as to position a repair patch circumferentially thereon.

These and numerous other features and advantages of the invention will become apparent upon a careful reading of the following description, claims and drawings wherein like numerals denote like parts in the several views and wherein:

DETAILED DESCRIPTION OF THE INVENTION

Figure 1:
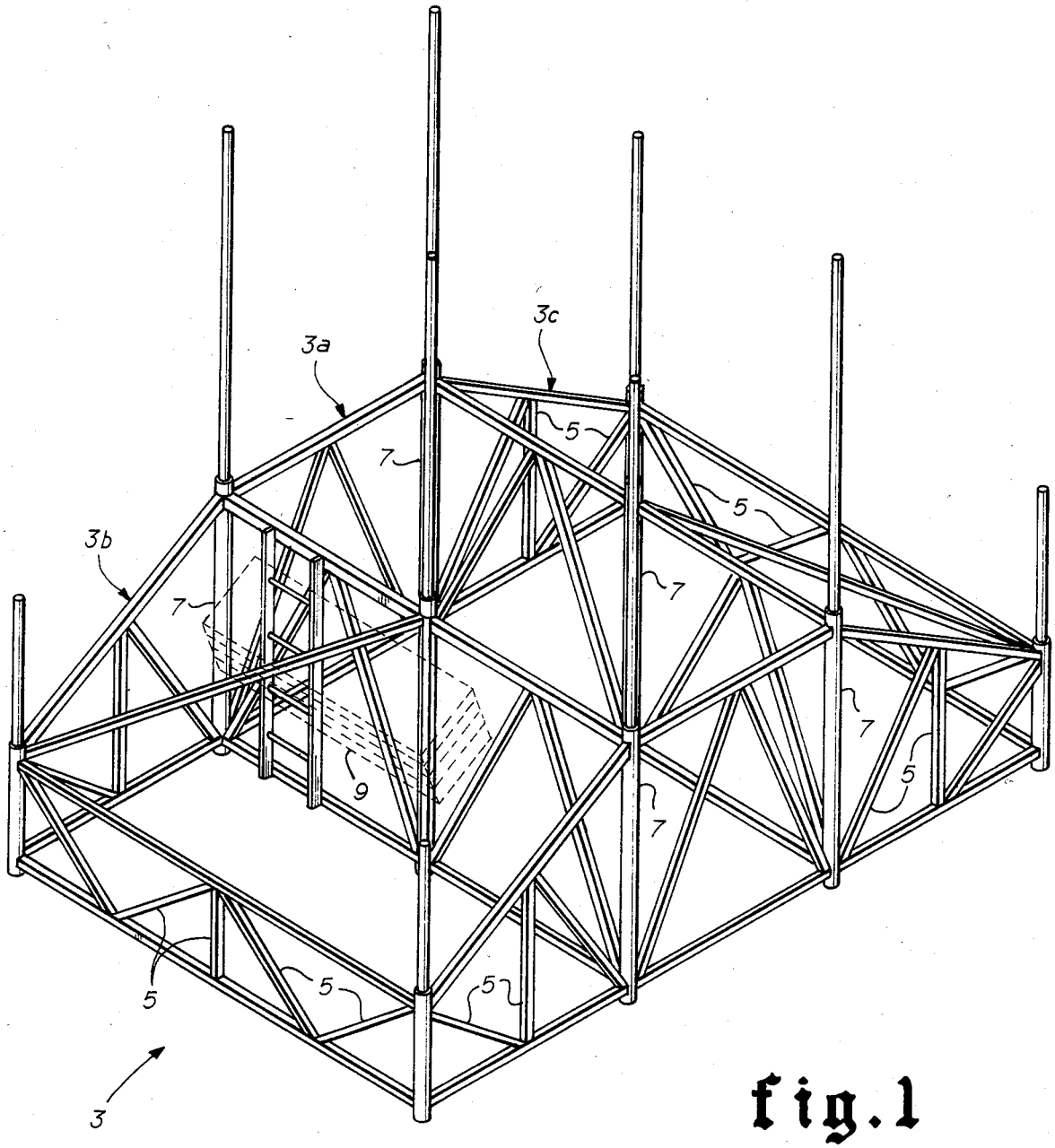
FIG. 1 illustrates the pipe truss base structure of the invention, onshore, preparatory to transport thereof to the body of water.

With reference now to FIG. 1 there is shown the pipe truss base structure 3 of the invention 3 consisting of the central section 3A and wing sections 3B, 3C. The wing sections 3B, 3C are integrally formed with the central section 3A so as to stabilize the latter in fixed position. The sections 3A, 3B and 3C are formed in generally box-like configuration with the wing sections 3B and 3C being somewhat truncated. A plurality of trusses 5 reinforce the box-like configuration of the wing sections so as to produce a relatively rigid and nonvibrating structure. The central section 3A is characterize by a plurality of uprights or connection means 7 for guiding and receiving cooperating connections from the work platform (described hereafter) temporarily affixed to and carried by the pipe truss base structure is a plurality of catwalk sections 9, also to be described hereinafter.

Figure 2:
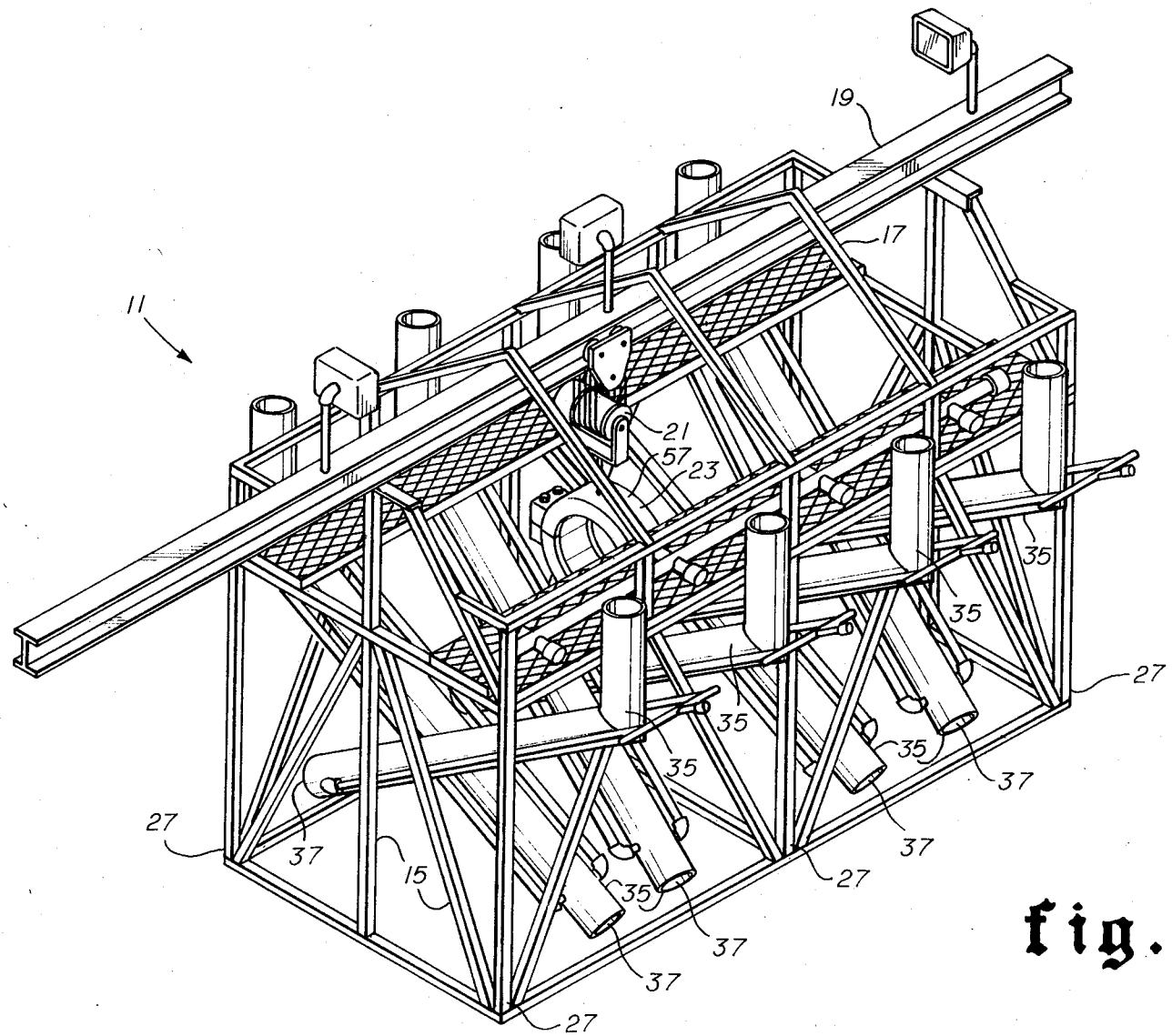
FIG. 2 illustrates the work platform of the invention, showing the eductors and piping system.
Figure 3:
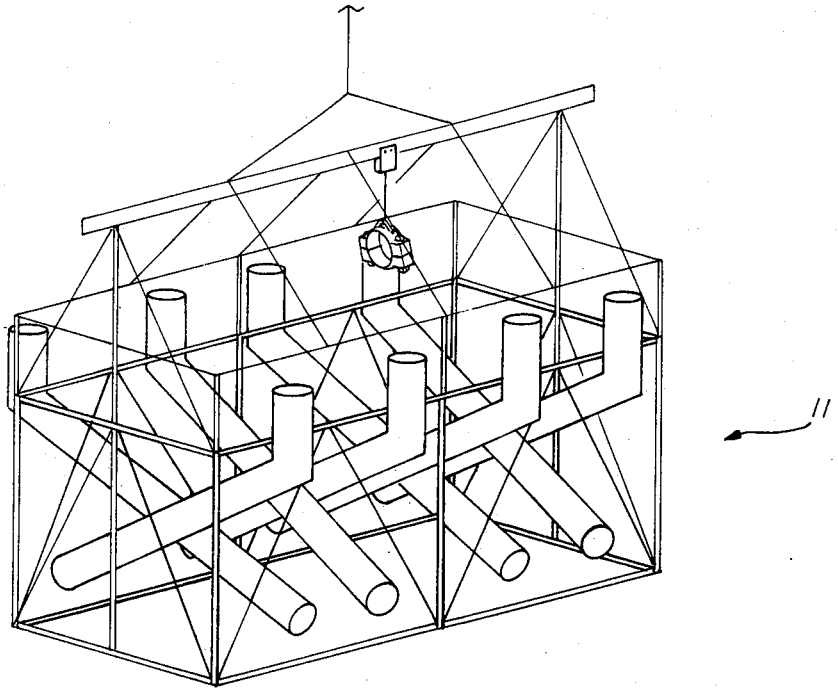
FIG. 3 illustrates movement of the work platform to the work area above the pipe truss base structure, preliminary to final deployment thereon.
Figure 3:
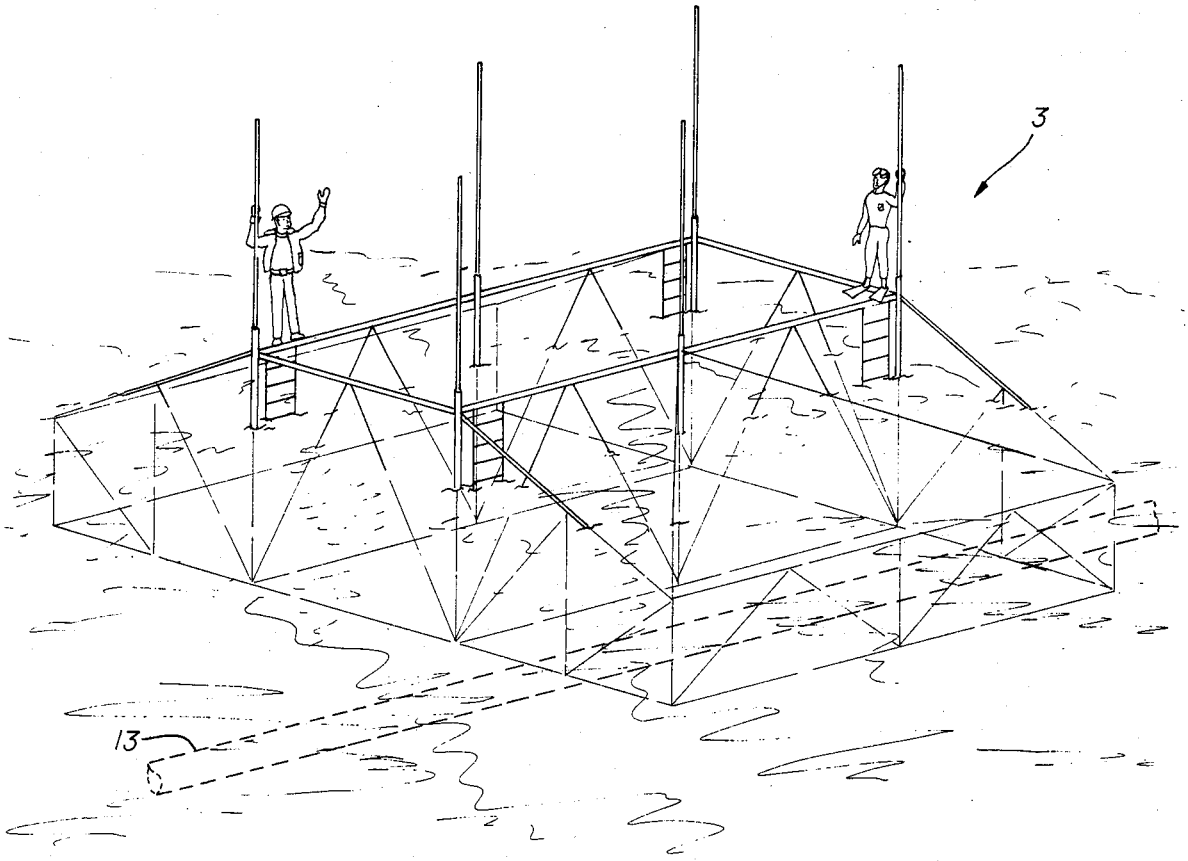
Figure 4:
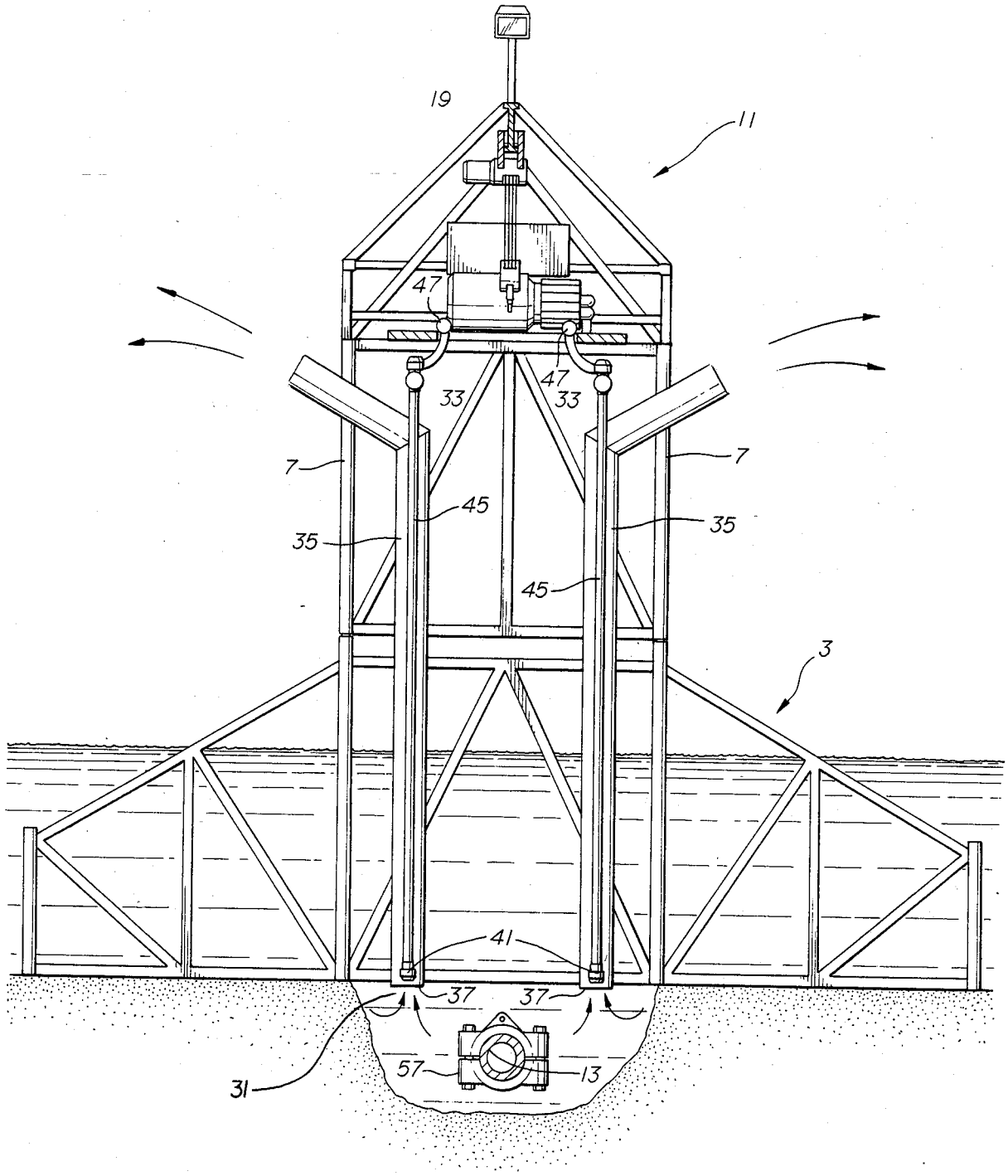
FIG. 4 illustrates the work platform in place with the eductors operating to excavate the pipe bed.

In FIG. 2 there is shown a work platform means 11 adapted to be transported to and set on the pipe truss base structure 3. The work platform means 11 is set upon the base structure 3 after the latter had been deployed in the water over, for example, a fractured pipeline 13. The work platform means 11 consists of a plurality of interconnected pipe or beam structures or the like 15, welded or otherwise interconnected in the configuration of a box having a hipped roof section 17 thereabove and a supporting beam means 19 at the apex thereof. The supporting beam means 19 is adapted to carry block end tackle 21 for raising and/or lowering the split collar means 23 described hereafter.

The pipe truss base structure 3 is rectangular in planned configuration and is adapted to be set with its longitudinal axis normal to the longitudinal axis of pipeline 13. The work platform means is characterized by a plurality of cooperating connection means 27 which are adapted to telescopically receive the connection means 7 extending upwardly from the pipe truss base structure when the work platform means 11 is aligned therewith and set thereon. Thus, it would be recognized that the work platform 11 sits at an elevated position above the pipe truss base structure 3 and above the surface of the body of water. The pipe truss base structure 7 thus serves as a foundation constructed only of relatively thin pipe or beam with no walls so that there exists a relatively free flow of current and/or surf therethrough and beneath the work platform 11.

Pivotally affixed 33 along the sides of the work platform 11 and at the upper end thereof is a plurality of eductor pipe means 35. Communicating with the entry end 37 of the eductor pipes 35 is a jetting nozzle 41. High pressure air is fed to the jetting nozzle via conduits 45. Air to the nozzles 41 is controlled by valves 47. Air lines supply high pressure from a compressor positioned on the work platform to the jet conduits 45. The jet conduits, compressor, air lines and all ancillary equipment is adapted to be supported on the catwalk floor 51 of the work platform.

Structurally supported by the work platform 11 is the aforementioned elongate beam means 19 and extending the length thereof. Supported as if on a track from the beam means 19 is the horizontally movable block end tackle means 21. The block end tackle means 21 is adapted to carry a pipe repair collar 57, such as a split type repair collar of predetermined diameter for installation on the pipe surface at the point of fracture by divers and other repair personnel. The repair collar means 57 can be lowered downwardly through the work platform 11 and into and beneath the water to the pipe surface where it will be installed by repair personnel.

In operation of the method of the invention it necessarily follows that the location of the pipeline fracture or the object to be worked on must first be ascertained with accuracy. Once the location is determined the pipe truss base structure is ready for transport to the location. Divers are deployed at the location while the pipe truss base structure 3 is transported from the shoreline, such as by helicopter, whereupon arrival at the designated location the base structure is lowered onto the surface of the water with the divers stabilizing the position of the structure as it descends. Prior thereto the angular position of the pipeline beneath the surface of the water or the angular position of such other object that is to be worked on may be designated by a pair of buoys, which designate a line corresponding to the axis of the submerged article. Thus, the pipe truss base structure 3 will be deployed with its elongate axis normal to the line of the buoys and with such imaginary line running centrally or equi-distant between the ends of the pipe truss base structure 3. Once the pipe truss base structure is positioned properly over the surface of the body of water it is lowered thereinto and deployed on the floor therebeneath. Thereafter the divers may climb to the upper level of the pipe truss base structure and await the work platform 11. The work platform would be transported to the location, also such as by helicopter. Prior thereto all of the equipment thereon, including the component parts such as the eductor pipe means 35 are firmly secured and tied against movement while it is being transported. The work platform means is lifted from its shoreline location and transported to the pipe truss base structure, the central connection means 7 of which are extending above the surface of the water. The wing sections 3B, 3C of the base structure are likely submerged or partially submerged. With the divers standing on the upper level of the pipe support base structure the work platform means 11 is lowered to within reaching distance of the divers where it is then swung into proper orientation with the connection means 5 so that the cooperating connection means 27 on the work platform 11 are aligned with the connection means 5 of the pipe support base structure. At such time the work platform is lowered into telescoping engagement between the cooperating connection means and thereby locked into position by the weight of the platform resting in fixed position on the base structure. At this point actual deployment of the working equipment begins.

The eductor means 31 which are pivotally connected at 33 to the top of the work platform, and otherwise tied securely for transportation purposes, are untied and pivotally moved to their operating position by the working crew. The operating position of the eductor means 31 occurs when the jetting nozzles 41 at the lower end thereof are aligned with the sand and soil covering the submerged pipeline. The air hoses are connected to each of the jetting nozzles 41 through the jet conduits 45. Vacuum hoses to the eductor pipes 35 are also connected so as to enable suctioning of the particulate dislodged by the jetting nozzles. The repair collar means 57 is deployed to the block end tackle means 21. After the eductor pipe means and cooperating jetting nozzles 41 are securely fixed in position above and on each side of the pipeline, or other object to be worked on, the digging operation may begin. This is carried out until the pipeline is revealed beneath the surface of the water sufficiently to enable divers to work thereon. The repair collar means 57 is lowered into the water by crewmen on the work platform means and guided into position by divers. The split collar is deployed around the submerged pipe which at this point in time has been sufficiently excavated to allow positioning of the collar around the circumference of the pipeline. It will be recognized that the jetting or vacuuming of the work area will vary, in degree, depending upon the particular type of work to be done and the shape or type of article on which the work is being done. The purpose of the jetting nozzles 41 and eductor means 35 is thus to prepare, cleanse and reveal the area surrounding the work object, all in order to facilitate the work to be done thereon.

The foregoing description of the invention, both in form of apparatus and in method, has been directed to a particular preferred embodiment in accordance with the requirements of Patent Statutes of the United States and for purpose of explanation and illustration. It will be apparent, however, to those skilled in this art that many modifications and changes in the apparatus and the method, and in the sequence of the method, may be made without departing from the scope and the spirit of the invention. For example, the overall configuration of the pipe truss base structure and work platform described herein is proposed primarily for work on a submerged pipeline which, of course, is a linearally elongate object. It is contemplated therefor that different types of objects will require different configurations of platforms and base structures. Likewise the object of the work to be performed, such as salvage versus repair or retrieval will influence not only the configuration of the platform but the ancillary equipment supported thereon. Thus, numerous modifications on the invention will be apparent to those skilled in this art. It is the Applicant's intention in the following claims to cover all such equivalent modifications and variations as reasonably fall within the true spirit and scope of the invention.

That which is claimed and desired to be secured by a United States Letters Patent is:

1. In an apparatus for performing work on an object submerged on the floor of a body of water and wherein the apparatus is adapted to be transported to the work site and removed therefrom when the work is completed, comprising:

a base structure means adapted to be deployed on the floor of the body of water in a working relationship to an object on which the work is to be performed, a work platform means adapted to be disposed on top of said base structure means, connection means affixing said base structure to said work platform means, jetting means movably carried by said work platform means for excavating the floor of the body of water in and around the area of the object to be worked on, compressor means carried by said work platform and operatively connected to the jetting means, and repair and working equipment, as may be necessary, carried by the work platform to thus provide a portable and self-contained base of operations in the body of water.

2. The structure of claim 1, wherein there is provided eductor means movably affixed to the work platform means, said eductor means having an upper expulsion end and a lower vacumming end, the lower vacuuming end being adapted to be positioned in the body of water adjacent to the jetting means so that upon evacuation thereof the particulate created by the jetting means is vacuumed by the eductor means, said upper end of the eductor means positioned to project the particulate away from the working area.

3. The structure of claim 2, wherein the eductor means and the jetting means are structurally unitarily affixed to one another so that vacuuming of the jetting means inherently occurs as a consequence of movement thereof.

4. The structure of claim 1, wherein the work platform means is characterized by an elongate beam, and working equipment slightably movable along the length of said beam and supported therefrom so as to minimize movement of heavy articles through the use of manual labor.

5. In a structure to be used in a body of water for conducting working operations thereon in pursuit of repair or salvage of an object submerged in the body of water comprising:

a work platform means supported in the body of water by a structure sitting on the floor beneath the water surface, elongate eductor means movably affixed intermediate the ends thereof to the work platform means, said eductor means having an upper end and a lower end for receiving particulate that is vacuumed thereinto and expelled from said upper end, the upper end is protruding away from said platform means, jetting means operatively associated with said lower end of said eductor means for digging by dislodging the soil, sand and other particulate on the floor of the body of water adjacent to an object to be worked on for repair or retrieval or the like, and power means carried by the work platform for operating the jetting means and eductor means, thus enabling selective movement of the eductor means and jetting means so as to facilitate excavation and/or cleansing the work area around the object and the ultimate accomplishment of the work to be performed thereon.

6. A method for performing work on an object submerged in a body of water comprising the steps of:

(1) preparing a work platform at a location other than that at which the work is to take place, (2) transporting and deploying the work platform in the body of water over the object on which the work is to be performed, (3) operating jetting means affixed to the platform and carried thereby for revealing and/or cleansing the work object and the area thereabout so as to enable the performance of work on said object, (4) vacuuming the sand, soil and other debris produced by said jetting and expelling such sand, soil and in a direction away from the work platform means, (5) and performing work on the object over which the platform was deployed.

7. The method of claim 1 including the additional step of completing the work on the object and removing and transporting the platform away from the work site.

8. A method for performing work on an object submerged in a body of water through the use of a platform transported thereto and temporarily disposed thereover, comprising the steps of:

(1) preparing a base structure means adapted to be disposed on the floor of the body of water adjacent to the object to be worked on;

(2) transporting the base structure means to the location of the object and deploying the base structure means on the floor thereat;

(3) preparing a work platform means at a location remote from the work site;

(4) transporting the work platform means to the work site and to a position thereabove the base structure means and deploying the work platform means onto the top of the base structure means;

(5) affixing the work platform means to the base structure means to thus provide a stable platform from which work effort may take place;

(6) positioning jetting means operably carried by the work platform-base structure means and actuating the jetting means to dislodge earth, sand and/or debris from the area of the work object to reveal the work object to enable the performance of work thereon, (7) vacuuming the soil, sand and/or debris from beneath the body of surface of water in the area of the object to be worked on and expelling the soil, sand and debris and expelling the soil, sand and debris through eductor means in a direction away from the work platform, and performing work on the object after it has been sufficiently revealed on the floor of the body of water;

and removing the work platform means from the base structure and transporting the work platform away from the location of the object;

removing the base structure and transporting it away from the area of the work object.

9. The method of claim 7 including the additional step of positioning a plurality of jetting-eductor means around the object to be worked on so as to excavate the floor of the body of water there and around the object when it is submerged in the body of water, each of said jetting-eductor means to be positioned manipulatively while movably affixed to the work platform.

10. The method claim 8 wherein the object to be worked on comprises a defective pipeline and the base structure is positioned uniformly thereover with the axis of the defective pipeline running normal to the long axis of the base structure so that the base structure is deployed in a straddling position thereover;

and jetting and excavating through the eductors sand, soil and debris from around the defective pipeline in an amount sufficient to reveal the circumference of the defective pipeline to a workman beneath the surface of the body of water;

and lowering a repair apparatus supported on the work platform into and beneath the body of the surface of water from a position directly over the defect in the pipeline;

positioning the repair apparatus around the circumference of the pipeline so as to repair the defect therein.

* * * * *